US007954431B2

(12) United States Patent
Jung et al.

(10) Patent No.: US 7,954,431 B2
(45) Date of Patent: Jun. 7, 2011

(54) METHOD FOR DETERMINING OPERATING PARAMETERS OF A PRINTING PRESS

(75) Inventors: Jochen Jung, Sandhausen (DE); Rolf Müller, Nussloch (DE); Michael Rohleder, Rauenberg (DE); Matthias Niedernhuber, Heidelberg (DE)

(73) Assignee: Heidelberger Druchmaschinen AG, Heidelberg (DE)

( * ) Notice: Subject to any disclaimer, the term of this patent is extended or adjusted under 35 U.S.C. 154(b) by 216 days.

(21) Appl. No.: 11/811,432

(22) Filed: Jun. 8, 2007

(65) Prior Publication Data

US 2007/0283827 A1 Dec. 13, 2007

(30) Foreign Application Priority Data

Jun. 9, 2006 (DE) ..... 10 2006 026 957
Sep. 6, 2006 (DE) ..... 10 2006 041 721

(51) Int. Cl.
*B41F 33/00* (2006.01)

(52) U.S. Cl. ..... 101/484; 101/488

(58) Field of Classification Search ..... 101/488, 101/487, 484
See application file for complete search history.

(56) References Cited

U.S. PATENT DOCUMENTS

| | | | | |
|---|---|---|---|---|
| 3,595,070 | A * | 7/1971 | Smith | 73/73 |
| 4,469,026 | A | 9/1984 | Irwin | |
| 4,591,517 | A * | 5/1986 | Whipple et al. | 427/378 |
| 4,888,885 | A * | 12/1989 | Caughey | 34/503 |
| 5,105,558 | A * | 4/1992 | Curry | 34/449 |
| 5,423,260 | A | 6/1995 | Goldberg et al. | |
| 5,539,500 | A * | 7/1996 | Hamamichi et al. | 399/97 |
| 6,649,095 | B2 * | 11/2003 | Buja | 264/40.6 |
| 6,877,247 | B1 | 4/2005 | DeMoore | |
| 7,092,668 | B2 * | 8/2006 | Behnke et al. | 399/336 |
| 2002/0007927 | A1 * | 1/2002 | Vahatalo et al. | 162/198 |
| 2007/0089623 | A1 | 4/2007 | Hamamoto et al. | |
| 2007/0113748 | A1 | 5/2007 | Geissler et al. | |

FOREIGN PATENT DOCUMENTS

| | | | |
|---|---|---|---|
| DE | 4433904 | A1 | 4/1995 |
| DE | 4405332 | A1 | 8/1995 |
| DE | 196 16 692 | A1 | 11/1997 |
| DE | 10159999 | A1 | 6/2003 |
| EP | 0 025 878 | A1 | 4/1981 |
| EP | 0798116 | A1 | 10/1997 |
| EP | 1 142 711 | B1 | 2/2006 |
| EP | 1142711 | B1 | 2/2006 |
| EP | 1777069 | A2 | 4/2007 |
| JP | 402052901 | A * | 2/1990 |
| RU | 2183065 | C2 * | 6/2002 |
| WO | 0216139 | A1 | 2/2002 |
| WO | 2005108082 | A1 | 11/2005 |

* cited by examiner

*Primary Examiner* — Anthony H. Nguyen
(74) *Attorney, Agent, or Firm* — Laurence A. Greenberg; Werner H. Stemer; Ralph E. Locher

(57) ABSTRACT

A printing press, in particular a sheet-fed offset printing press, includes at least one control device, a plurality of printing units, one or more varnishing units, and one or more dryers. Variables determining a dryness of the printing material are determined and used to optimize the drying process. For that purpose, the important material streams influencing the drying process are determined at least for the region of the printing press that contains the drying device(s).

18 Claims, 7 Drawing Sheets

METHOD FOR DETERMINING OPERATING PARAMETERS OF A PRINTING PRESS

CROSS-REFERENCE TO RELATED APPLICATIONS

This application claims the priority, under 35 U.S.C. §119, of German applications DE 10 2006 026 957.8, filed Jun. 9, 2006, and DE 10 2006 041 721.6, filed Sep. 6, 2006; the prior application is herewith incorporated by reference in its entirety.

BACKGROUND OF THE INVENTION

Field of the Invention

The invention lies in the printing technology field. More specifically, the invention relates to a method for determining operating parameters of a printing press, wherein variables determining the dryness of the printing material are determined and used to optimize the drying process.

In sheet-fed rotary printing presses, in particular sheet-fed offset presses with varnishing units and drying devices, a large number of parameters have to be optimized during operation in order to arrive at good printing results and as few rejects as possible. For instance, in the case of a high application of varnish, it is difficult in particular to obtain the dry sheet, in order that the sheets delivered do not stick together later in the stack. At the same time, a defect-free, normally highly glossy varnish layer is expected, which cannot readily be achieved in the case of inadequate incomplete drying nor in the case of excessively fast drying or excessively high temperatures in the dryer. Then, the intention is to operate at the maximum speed during continuous printing, in order to produce as much as possible in the shortest possible time. Against this background, it is difficult for the operating personnel in the print shops to oversee all the necessary printing parameters and machine settings and to make them optimally. Each printer has his own understanding of the varnishing and drying process and, with this understanding, he adjusts the printing press and the dryers. Here, fundamentally wrong settings also arise. It is often also the case that the printer does not deduce whether he is operating at or in the vicinity of the optimum of the individual settings. If rejects are produced, he then has barely any possible ways of comprehending the erroneous sequences, because of the complexity of the influencing parameters.

Although the control of modern sheet-fed offset printing presses provides for the storage of parameters for following jobs, apart from the fact that this measure naturally helps only when a following job is actually also being printed, the environmental conditions are not always identical during the same jobs. For instance, the temperature and humidity of the ambient air in the print shop can fluctuate, the moisture of the paper to be printed can vary in the feed stack, and much more.

Is also known to provide characteristic curves for the dryers, wherein for example the dryer output required is plotted as a function of the machine speed. However, this helps the printer only in one subarea, specifically in setting the two parameters which are correlated with each other via these characteristic curves.

It has also already been proposed, for example in European patent EP 1 142 711 B1, to control the dryer of a sheet-fed offset printing press with the aid of sensors, with which the temperature inside and outside the printing press and the printing speed are measured, and at the same time to take into account the metering of ink or varnish, which may depend on the subject. Using such a method, however, the problems mentioned at the beginning cannot be eliminated, so that the control claimed in the patent has hitherto not become widespread.

U.S. Pat. No. 4,469,026 and its European counterpart EP 0 025 878 A1 describe an inkjet printer wherein the energy input and the residence time of the sheet on the fixing drum are set by a control system, which takes ink density, ink type and ambient humidity into account. Here, the ambient humidity sensor controls the time during which the sheet has to remain on the fixing drum before it is allowed to run into the drying assembly.

German patent application DE 196 16 692 describes a control system for the microwave dryer of a printing press which operates by using the water content of the printed ink.

The prior art methods and devices are not suitable to solve the problems outlined at the beginning. In particular in sheet-fed offset printing presses comprising varnishing units wherein emulsion varnishes are applied and are dried with hot air or infrared radiation, the prior art methods do not help further.

SUMMARY OF THE INVENTION

It is accordingly an object of the invention to provide a method of determining operating parameters of a printing machine which overcomes the above-mentioned disadvantages of the heretofore-known devices and methods of this general type and which allows printing presses with emulsion varnishing units and thermal dryers to be operated more reliably.

With the foregoing and other objects in view there is provided, in accordance with the invention, a method of determining operating parameters of a printing press, the printing press including at least one control device, a plurality of printing units, at least one varnishing unit, and at least one dryer device. The method comprises the following steps:

determining variables defining a dryness of a printing material and using the variables to optimize a drying process;

determining important material streams influencing the drying process at least for a region of the printing press containing the drying device.

The invention is particularly suited for implementation in sheet-fed offset presses.

In accordance with an alternative embodiment of the invention, there is provided a method of determining operating parameters of a printing press, in particular a sheet-fed press, including at least one control device, a plurality of printing units, at least one varnishing unit for emulsion varnishes, and a thermal dryer device. The method comprises measuring and displaying an atmospheric humidity in waste air emanating from the dryer device.

With the above and other objects in view there is also provided, in accordance with the invention, a printing press, comprising:

at least one control device;

a plurality of printing units and at least one varnishing unit and at least one dryer device connected to said control device;

a plurality of sensors assigned to said dryer device and disposed to measure variables determining a drying process of printing material, said sensors measuring a moisture of material streams influencing a drying process; and a computing unit connected to receive the measured values from said sensors and configured to process the measured values.

In an alternative implementation of the invention, the printing press—which is preferably a sheet-fed rotary offset press—comprises:

a control device;

a plurality of printing units, at least one varnishing unit for emulsion varnishes, and a thermal dryer device formed with a waste air duct;

a plurality of sensors for measuring variables influencing a drying process, said plurality of sensors including at least one sensor disposed in said waste air duct for measuring an atmospheric humidity in waste air in said waste air duct of said dryer device; and a display device for displaying a humidity or an amount of water discharged via the waste air.

In other words, in order to optimize the drying process, the important material streams influencing the drying process are determined in the region of the drying device of the printing press. These material streams are primarily the atmospheric humidity of the feed air and the atmospheric humidity of the waste air from the drying device, and also the moisture transported in with the printing material, specifically primarily the application of varnish. From these variables, the moisture balance and therefore the dryness of the printing material transported through the dryer can be determined, the reliability of the method additionally gaining if the material moisture of the printing material itself is also determined before and after the printing or varnishing and drying. It is particularly advantageous and helpful for the operating personnel of the printing press if the essential characteristic data of the material streams determined is displayed visually on a monitor. This can be done not only by displaying the raw numerical values but by means of appropriate graphical preparation and display in the form of measuring bars, which reveal at which points or wherein material streams possible interventions are provided, and if so wherein direction, and whether and to what extent the material streams have in reality departed from their respective optimum. In this case, alternatively, the changes in the values indicated in relation to standard or intended values, either predefined or set by the printer himself, can also be indicated. It is also advantageous to determine limiting values, below which the process runs stably, for, for example, the quantity of moisture transported away, the quantity of varnish and/or the temperature of the printed sheet.

The printing press suitable for implementing the method therefore has sensors for measuring the important material streams influencing the drying process and also a computing unit, wherein preparation or further processing of the measured values is carried out and/or the moisture balance of the material streams can be determined. However, since it is important not only to measure the relative humidity, for example of the feed and waste air of the dryer, but also the flow of the water, that is to say the quantity of water, actually conveyed in via the feed air and out via the waste air, the temperature and the volume flow of the feed and waste air are expediently also measured, in order in this way, in conjunction with the relative atmospheric humidity, to determine the quantity of water vapor carried away. This quantity of water vapor plus the part of the water absorbed into the material of the printed sheet, that is to say into the paper, corresponds approximately to the quantity of water input via the varnishing if the printing material leaves the dryer with a well dried varnish layer.

Other features which are considered as characteristic for the invention are set forth in the appended claims.

Although the invention is illustrated and described herein as embodied in method for determining operating parameters of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
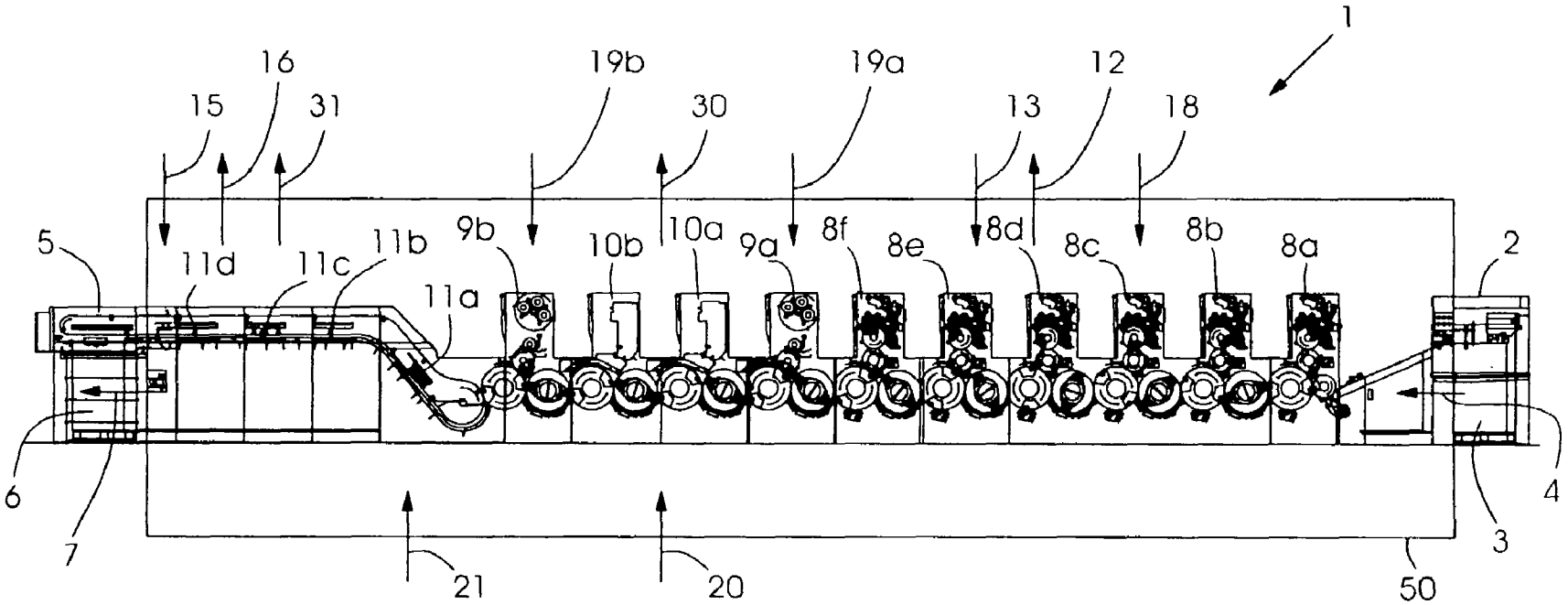
FIG. 1 is a schematic illustration of a sheet-fed offset printing press of inline design, wherein the important material streams are symbolized by arrows.
Figure 2:
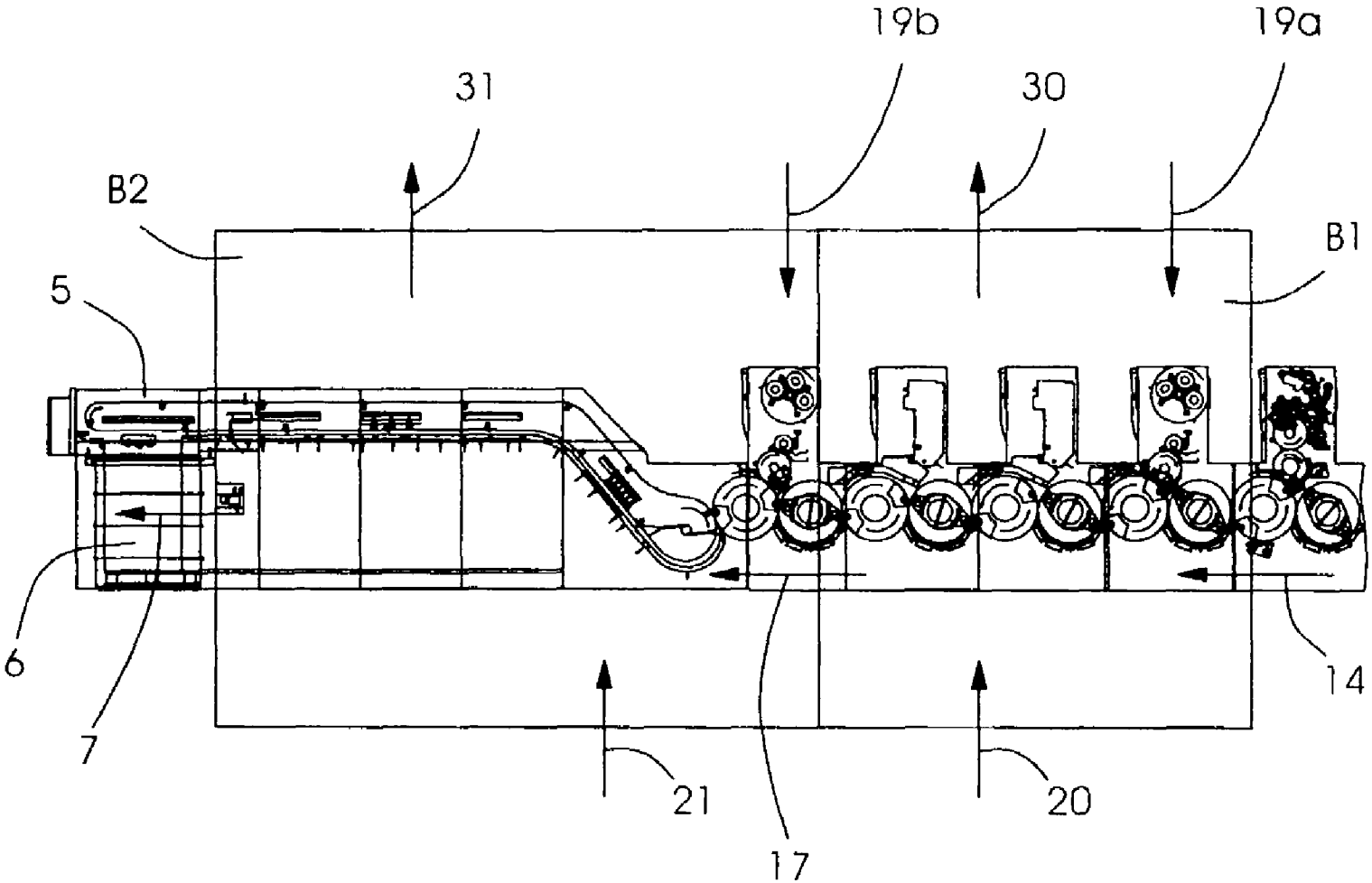
FIG. 2 shows an extract from the printing press according to FIG. 1 in the region wherein the drying devices are arranged.

Referring now to the figures of the drawing in detail and first, particularly, to FIG. 1 thereof, there is shown an offset printing press 1 of inline design comprising a feeder 2, wherein the unprinted paper stack 3 is located, six printing units 8*a* to 8*f* for the four primary colors and, if appropriate, two further special colors, a first varnishing unit 9*a*, following the latter two dryer units 10*a* and 10*b*, a second varnishing unit 9*b* and a delivery 5 with the sheet delivery stack 6. In the region of the chain guides of the delivery 5, four further dryer units 11*a* to 11*d* are arranged one after another in the sheet transport direction. A printing press of this type is offered, for example, under the designation Speedmaster® XL 105-6-LYYLX3 by Heidelberger Druckmaschinen AG. In the region designated by 50, arrows which are directed inward or outward symbolize the points in the printing press at which moisture is put into or removed from the printing process.

The arrow 4 symbolizes the moisture content which is already in the printing material sheets stacked up in the feeder 2. At this point, moisture is understood to mean the material moisture of the paper, that is to say the quantity of water which is bound in the paper per unit quantity of the latter. A material moisture of 8% in the feed paper stack therefore means that a paper sheet of 100 grams contains 8 grams of water. If, following its acclimatization, the paper stack is in the "equilibrium state" with the ambient air in the print shop, then the equilibrium moisture can be determined via the sorption isotherms of the paper with knowledge of the relative atmospheric humidity and the temperature of the air in the print shop. However, such acclimatization of the paper stack in the feeder has often not taken place at all. This is because it is entirely possible that paper stacks are brought from a store to the printing press in the short term and the material moisture of the paper then still corresponds to the climatic conditions in the storeroom. Therefore, in order to determine the material moisture, it is more advantageous to use a measuring method which detects the moisture in the paper directly. Known for this purpose are methods based on high-frequency, microwave or infrared absorption measurements.

The printing units 8 are printing units for wet offset, that is to say they have a dampening unit via which the printing plate is dampened before being inked, some of this dampening solution reaching the sheet to be printed via the blanket cylinder in the printing unit. This input of moisture is symbolized by the arrow 18.

The arrow 13 represents the proportion of water which itself originates from the ink printed onto the sheet. Of course, in the case of oil-based offset printing inks, this proportion is low. The arrow 12 takes account of the fact that, during the transport of the printed sheet through the machine, a certain amount of evaporation takes place, since the printing unit moistened with ink and dampening solution and the printed sheet are moister than the surrounding air in the printing press.

However, the most important moisture streams are formed by the varnish layers applied to the printed sheet in the varnishing units 19*a* and 19*b*, in any case when they are not UV-curable varnishes but water-based varnishes, such as emulsion varnishes. This is symbolized by the arrows 19*a* and 19*b*.

A further very important exchange of moisture takes place in the dryer units 10*a* and 10*b* and also 11*a* to 11*d*. These dryer units are supplied with feed air from the surroundings (arrows 20 and 21) at the relative moisture of about 50% prevailing in the print shop, which air is then heated up (in the case of hot air dryers) when it enters the dryer 10*a*, 10*b*, 11*a* to 11*d*, for example, in the case of IR radiation dryers, when it enters the drying chamber. Following the absorption of part of the application of varnish and of the moisture from the varnish into the paper material of the printed sheet, the waste air (arrows 30 and 31) is then intended as far as possible to remove the quantity of water contained in the varnish layer from the dryer units 10 and 11 in the form of vapor, in order that the varnished sheets do not glue to blocks on the stack. This material moisture from the printed sheet conveyed onward is symbolized by the arrow 7. In addition to that, although to a low extent, moisture is also put into and removed from the printing press 1 via the powder stream (arrow 15) in the delivery of the printing press and via escaping leakage air (arrow 16).

It has now transpired that, in a printing press of the type mentioned at the beginning, that is to say an offset printing press 1 comprising a varnishing unit 9*a*, 9*b* which prints water-containing varnish and one or more thermal dryer units 10, 11, that is to say hot air or infrared dryers, the application of varnish and the feed air 20 and the waste air 30 from the dryer units 10*a*, 10*b* represent the greatest inputs and outputs of moisture in the machine, that these are therefore the most important moisture streams in the balance space designated B1, wherein the moisture of the printed sheet passing through can be changed. In this case, it is assumed that the moisture contained in the paper fiber and in the printing ink cannot readily be driven out of the printed sheet by the dryer devices 10*a*, 10*b*. In the case of a machine with a double varnishing unit, as shown here, before the second varnish layer is applied by the varnishing unit 9*b*, the first varnish layer should be thoroughly dried with the aid of the dryer devices 10*a* and 10*b* to such an extent that the varnish layer added in the second varnishing unit 9*b* is laid over it without difficulty. For example, the second varnish can certainly also be UV varnish, which should not/must not react with a still moist water-based varnish. However, even if there is likewise aqueous emulsion varnish in the second varnishing unit, the first varnish layer must already have been solidified in order that the second varnish layer can be applied without difficulty, for example for the production of particularly thick overall varnish layers.

The quantity of varnish applied can be adjusted in the printing press. In order to dry the sheet with the selected application of varnish in an optimum manner, the knowledge of the important operating parameters, in particular of the dryer units 10*a* and 10*b* and of the machine speed, easily permits an optimum result. For this purpose, however, it is necessary to know the important characteristic variables in the moisture balance.

Figure 3:
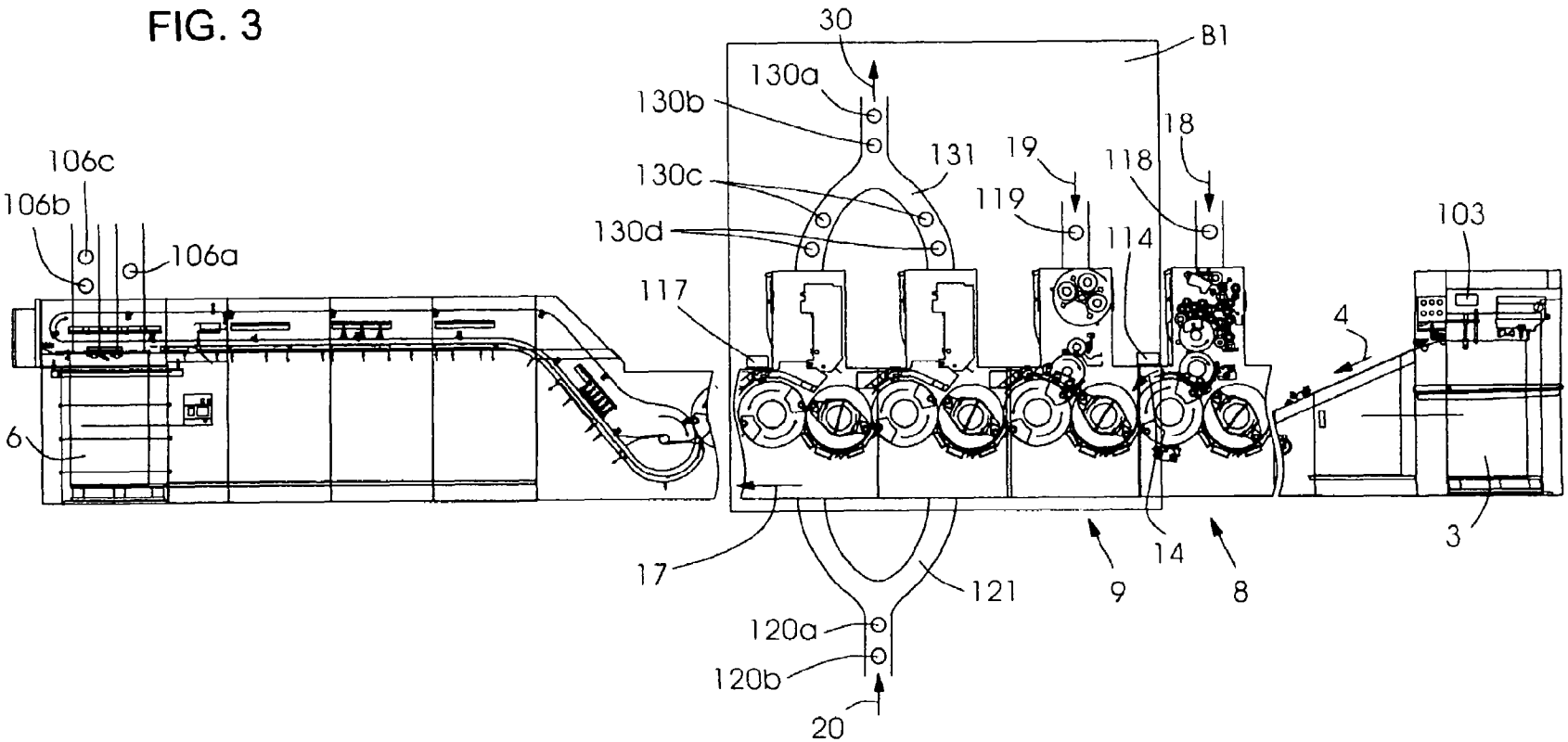
FIG. 3 is a simplified sketch of the printing press from FIGS. 1 and 2, wherein the arrangement of the sensors is sketched.

For this purpose, in the region of the printing press designated B1, a series of sensors is provided, with which these variables can be measured. This will be explained below by using FIG. 3. In order to measure the relative humidity rFL1 and the temperature TL1 of the feed air stream 20, a humidity sensor 120*a* and a temperature sensor 120*b* are arranged in the vicinity of the air inlet ducts 121 for the dryers 10*a* and 10*b*. Since here the relative humidity of the ambient air is measured in the print shop, a humidity sensor and a temperature sensor can be sufficient.

Furthermore, corresponding humidity sensors 130*c* and temperature sensors 130*d* and also pressure sensors 130*a* and flow sensors 130*b* are arranged in the waste air duct of the dryer 10*a* and of the dryer 10*b*. With these sensors, the quantity per unit time of the moisture stream removed from the machine can be clearly determined as the difference of the atmospheric moisture coming into the machine and coming out of the machine again. In particular, it is also possible to manage with the four aforementioned sensors 130 *a* to *d* for the waste air if the waste air ducts 131 of the two dryers 10*a* and 10*b* are combined. In order to measure the relative atmospheric humidity, the dew point or the absolute humidity, it is possible for example to use capacitive sensors, aspiration psychrometers or sensors which measure the moisture via the absorption of infrared radiation in the water bands.

Sensors which measure the relative atmospheric humidity can incidentally be arranged in a cooled measuring air stream branched off from the waste air stream, in order to increase the measuring accuracy. This is because, during cooling of the air stream, the relative humidity increases, so that the humidity measured values migrate into a region where the measuring inaccuracy is lower, assuming that no condensation of the moisture in the measuring air stream occurs. A suitable measuring cell which prevents the latter is described at the end of the illustration by using FIG. 7.

The quantity of water input via the application of varnish is measured with flow sensors 119 in the feed and return of the varnish supply device of the printing press 1. Instead, the quantity of varnish or its proportion of water in the case of chamber-type doctor systems can also be determined from the difference between the delivery outputs of the varnish feed pump and the varnish extraction pump. Taking account of the sort of varnish and its water content, which generally lies around 60% for emulsion varnishes, the quantity of water input at this point is calculated in a straightforward manner. A further possible way of measuring the quantity of varnish consumed is to register the weight or the decrease in weight of the varnish storage container by using a weighing cell.

In order to refine the method, further sensors are optionally provided, with which the water content already present in the sheet 14 running into the varnishing unit can be determined more accurately. Used for this purpose is a sensor 118, which determines the input of dampening solution 18 from the dampening solution consumption in the six printing units 8*a* to *f*. Furthermore, two temperature sensors 114 and 117 are provided, which determine the temperature of the sheet running into the varnishing unit and of the sheet leaving the dryer 110*b*. These temperature sensors are used for the purpose of determining the entry and exit temperature of the sheets. On the basis of the moisture balance, supplemented by the temperature difference experienced by the material stream, an energy balance of the drying process can be drawn. For this purpose, for example, use can be made of sensors which measure the temperature of the sheet without contact via the infrared radiation emitted by the sheet. Finally, in order to measure the material moisture in the feed stack 3 and in the delivery stack 6, a mobile electronic measuring instrument can be used, for example a sword sensor or a contact sensor 103 which, for example, operates on the principle of microwave absorption or conductivity of a hydroscopic electrolyte.

The signals from the sensors are processed in a computing unit 301 (FIG. 5), for example a commercially available measuring PC, to which the aforementioned sensors are connected via appropriate interface adapters. Characteristic variables and conversion factors relevant to the drying process are stored in the memory 302 of the computer 301, such as the water content of the varnish, the mathematical relationships for the conversion of relative atmospheric humidity $\phi$ into absolute humidity, as illustrated in the Mollier diagram according to FIG. 4, to mention only a few.

Numeral 303 designates the keyboard of the computer, and numeral 304 designates the monitor. On this monitor, as a setting aid for the printing personnel, the important characteristic data of the current varnishing and drying process is then displayed visually, prepared in graphic form. For example, the bar 220 represents a measure of the quantity of water running into the dryers 10 with the feed air 20, while the bar 230 indicates the quantity of water removed via the waste air. Both are proportional to the air stream F through the dryer, while the bar 230 can also be enlarged within certain limits via an increase in the temperature T or the heating output of the hot air dryer or an increase in the thermal radiation of the IR dryer.

The "dryer reserve" which may possibly still be present, that is to say the possibility of increasing the water content of the waste air still further by increasing the temperature or the IR radiation or the air flow, is illustrated on the display 304 as a further part bar designated 240.

The next bar 219 describes the quantity of water still contained in the varnish layer applied after the quantity of water input into the paper sheet and absorbed has been subtracted. On the basis of experience, this is about 50 to 60% of the quantity of water applied to the sheet overall via the varnishing.

A sheet with a dry varnish layer is obtained when the upper edge of the bar 219 does not exceed the upper edge of the bar 230 or does not exceed it substantially. The residual moisture of the varnish layer of the sheet running out of the dryer 10*b* is represented as a difference in a further bar 200. This residual moisture may be reduced firstly by reducing the application of varnish or by reducing the machine speed. This information is indicated as a help to the user in the form of corresponding symbols −L and −V with an arrow directed downward. Secondly, the residual moisture 200 can also be reduced by increasing the dryer temperature +T or increasing the air throughput +F, which is likewise symbolized once more by appropriate symbols on the bar 230.

Furthermore, pop-up menus 306 are used to display the exact measured values in the feed-air or waste-air duct of the dryer when the cursor 309 is brought close to the bar.

A good drying result for the sheet is obtained when the application of water resulting from the application of varnish in the varnishing unit 19*a* (100%) corresponds approximately to the sum of the quantity of water carried away as vapor in the dryer (50 to 60%) and the quantity of water absorbed into the paper underneath the varnish layer (40 to 50%). In the Speedmaster® XL105 printing press mentioned at the beginning, operated at the maximum continuous printing speed of 18,000 sheets per hour with the sheet format 105 cm by 75 cm with a typical wet application of varnish of 3.5 μm, this corresponds to a water input $F_{H2O}$ of 29 l/h, of which, from experience, 50% is absorbed into the paper and thus 50% remain in the varnish. This empirical value can be determined and verified more accurately if the paper moisture of the sheet is measured after leaving the dryer or in the delivery stack. Therefore, the dryer units 10*a* and 10*b* are expediently operated in such a way that 50% of the water input by means of the first varnish layer, symbolized by the arrow 19*a*, is removed again to the greatest extent in the form of vapor in the two dryers 10*a* and 10*b*.

Figure 4:
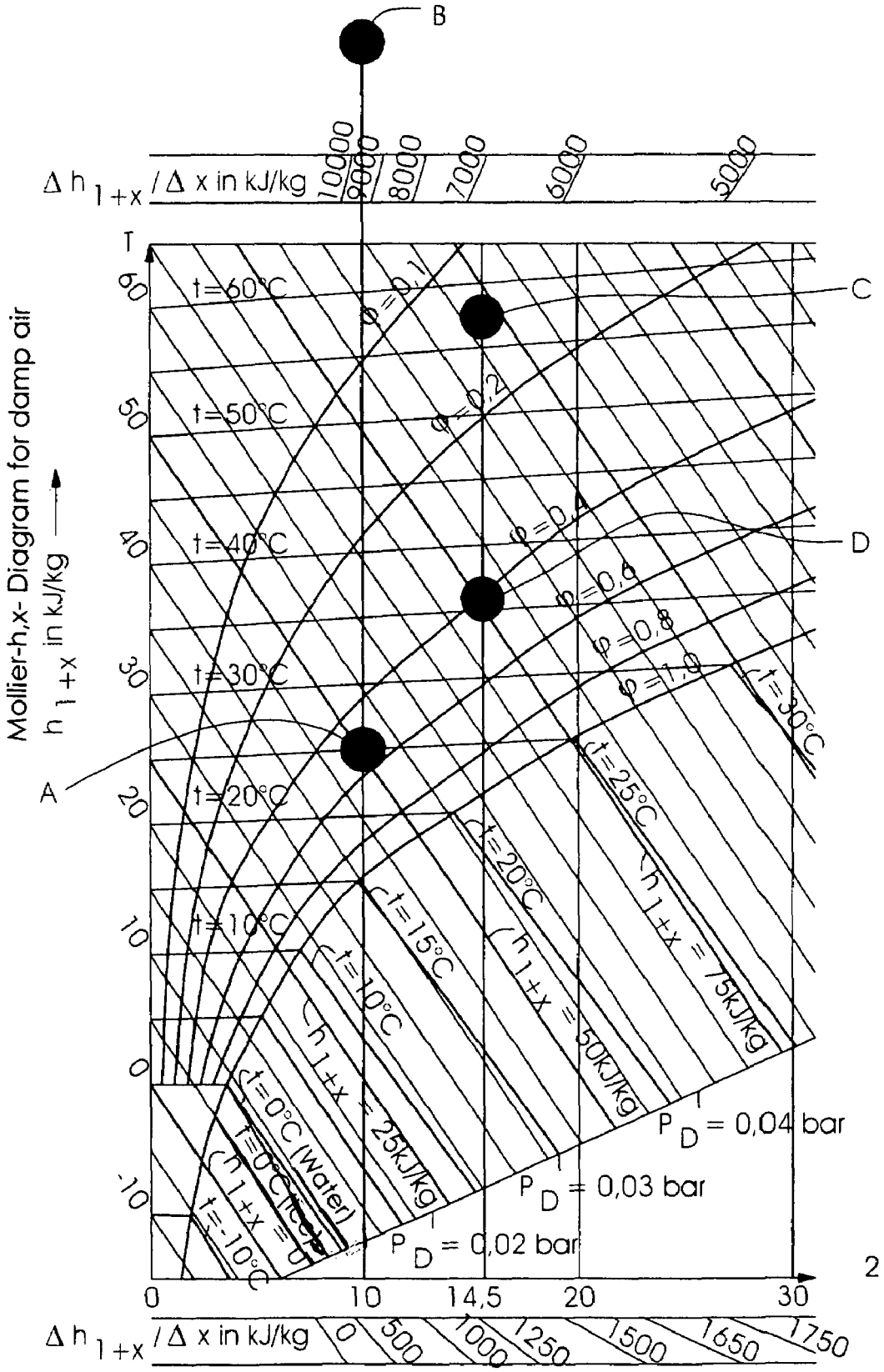
FIG. 4 illustrates a Mollier h,x diagram for the air passing through the dryer 10*a* in FIG. 1.

These relationships are reproduced in the Mollier diagram according to FIG. 4. The air in the print shop has a relative humidity of 51% at an ambient temperature of 25 degrees Celsius. This corresponds to a loading with 10 g of water per kilogram of dry air (point A).

In the hot air dryer 10*a* or 10*b*, this feed air is heated to 80° C. and then still has a relative humidity of 3.4% (point B). However, this changes nothing in the loading with 10 grams of water per kilogram of dry air.

Following the contact of the heated feed air with the moist, varnished sheet, the waste air extracted from the dryer units 10*a* and 10*b* has a temperature of 58 degrees Celsius and a relative humidity of 12.7%. This corresponds to a loading with 14.5 grams of water per kilogram of dry air (point C).

The relative humidity can also be measured in a cooled waste air bypass at 35 degrees Celsius. There, it then has a relative humidity of $\phi$=0.4, but this changes nothing in its loading with 14.5 grams of water per kilogram of dry air (point D).

During the operation at a continuous printing speed v of 18,000 sheets per hour, the blowers of the dryers 10*a* and 10*b* blow a volume flow of V=3000 cubic meters of air per hour or 3300 kg of (dry) air per hour through the dryer units. In this way, therefore, measured as a difference from the water or moisture stream already contained in the feed air, 15 kilograms of water vapor per hour therefore leave the printing press in the region of the dryer.

Figure 5:
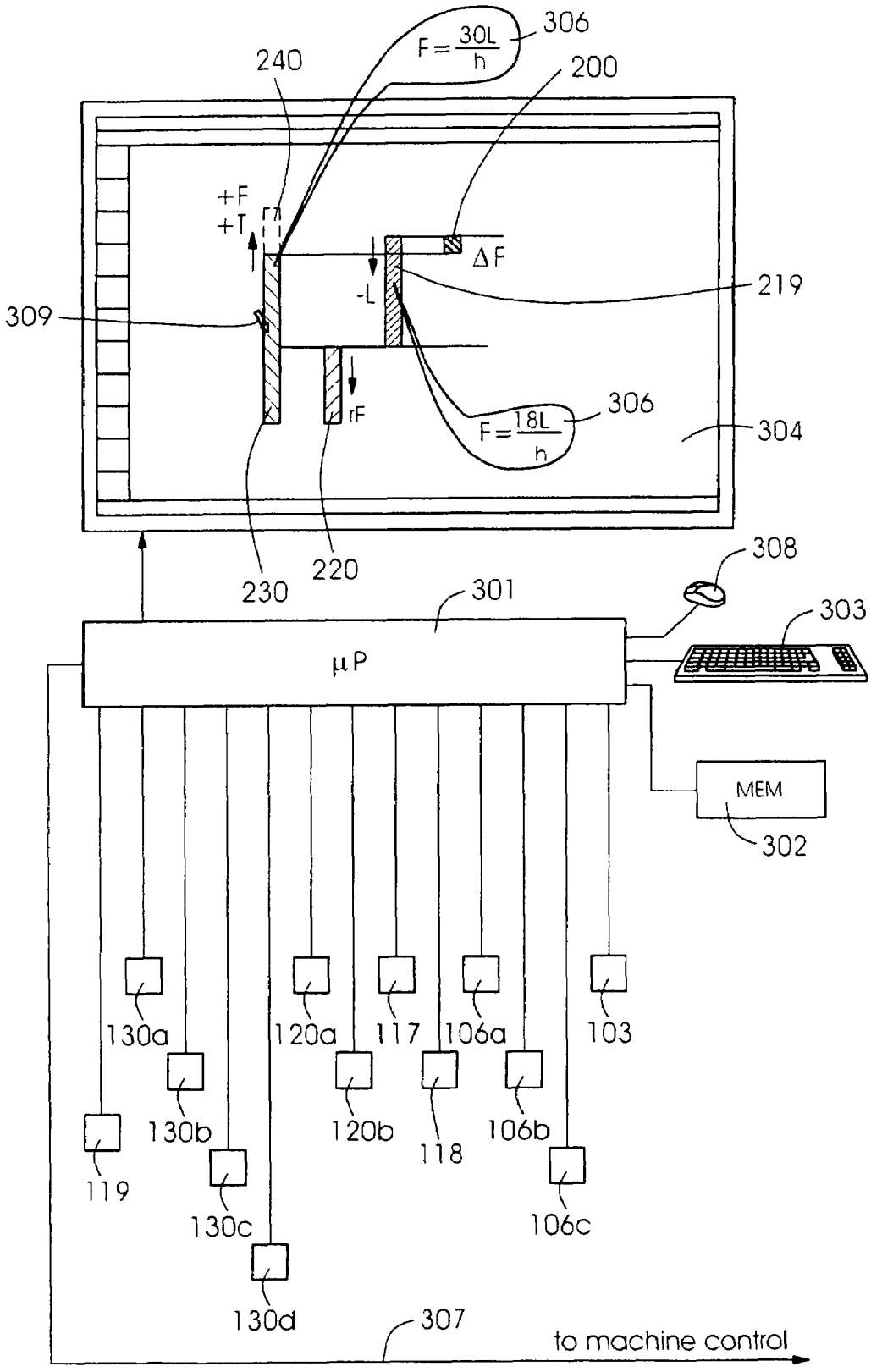
FIG. 5 shows a block diagram of the sensors and computing unit used in determining the material streams from FIG. 1.

The illustration according to FIG. 5 shows clearly that the residual moisture of the sheet leaving the dryer 10*b* can be influenced not only via increasing the heating output or via the quantity of water or water vapor removed by the waste air but by exerting an influence on a series of further variables. For instance, in addition to the classic measures such as reducing the application of varnish or lowering the machine speed, an influence can also be exerted on the drying results in a demonstrable way by using predried air or reducing the moisture of the sheet running into the varnishing unit.

Figure 6:
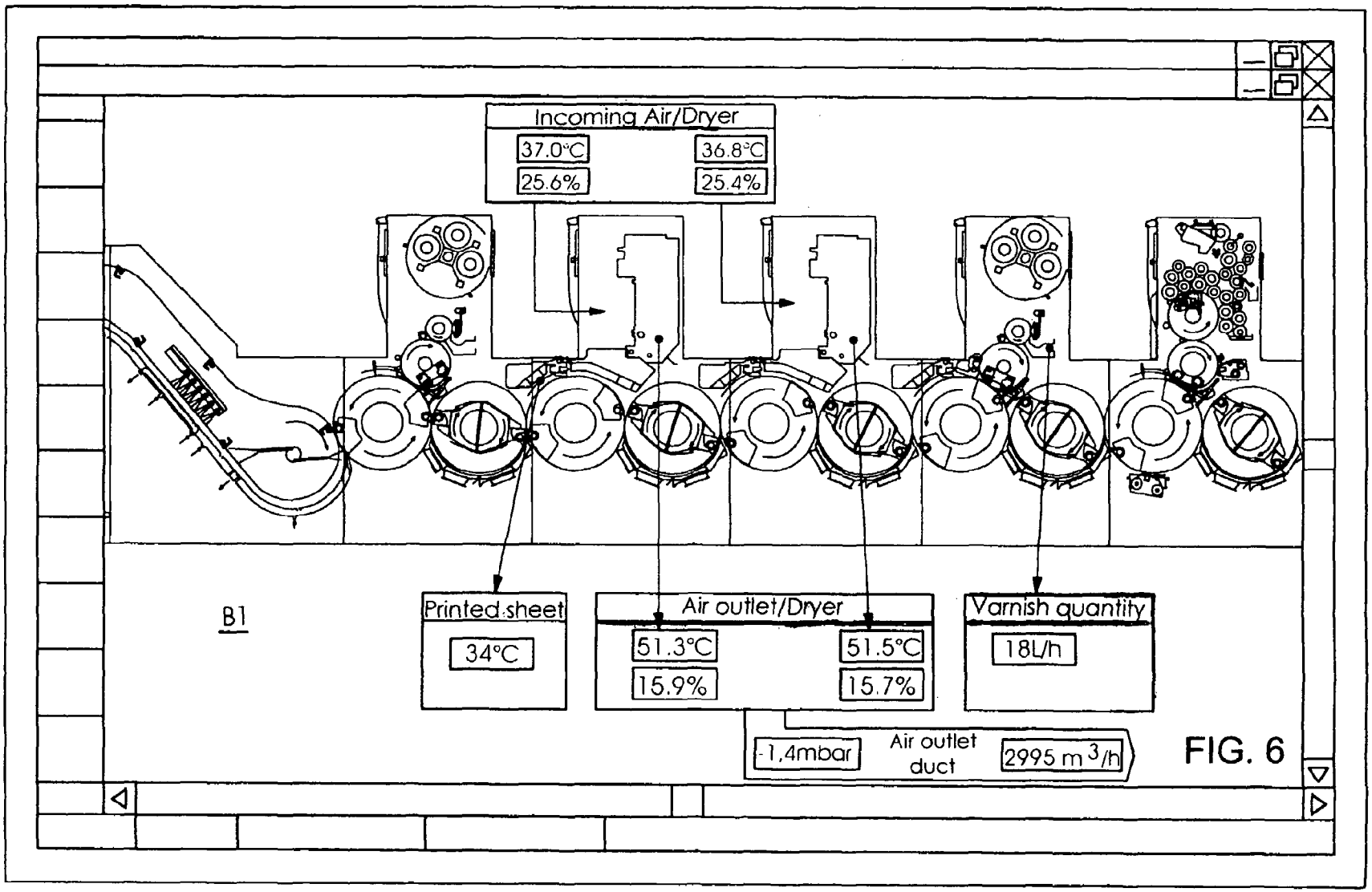
FIG. 6 shows an alternative example of the monitor display of the characteristic variables for the material streams in the region B1 of the printing press according to FIG. 2.

An alternative possible way of visualizing the measured results from the sensors is illustrated in FIG. 6. Here, the part of the printing press 1 containing the dryers 110*a* and *b* and the varnishing unit 9*a* is illustrated, and the measured values from the sensors are blended in as values, arrows directly representing the connection between the measuring locations of the sensors and the indicated measured values for the relative humidity rF, temperature T, pressure p and varnish flow rate FL. In this representation, it is possible to change from the display of the actual values to a display of the deviation from desired values themselves set or, for example, determined from an earlier job and then stored, for temperature, humidity and quantity of varnish. In the event that tolerance limits are exceeded, error messages can additionally be made visible on the monitor.

In the same way as for the balance space of the varnishing and drying via the first varnishing unit 9*a* of the printing press 1, a balance space B2 for the second varnishing unit 9*b* and also the dryers 11*a* to d can also be built up for the printing press 1 and displayed. For the purpose of the graphical representation of the second balance space on the monitor 304 (FIG. 5), by means of appropriate entries via the keyboard 303 of the computer 301, the monitor display can be switched over appropriately and switched over to the sensors arranged in the feed air 21 and waste air 31, respectively, and to sensors measuring the varnish stream 19*b*.

Moreover, the computer 301 has a data line 307, which connects it to the machine control system of the printing press. In this way, it is possible for changes made interactively on the monitor in the heating output or in the air volume flow of the dryers, the quantity of varnish applied and the machine speed to be transmitted directly to the machine control system and not to have to be made separately there.

Figure 7:
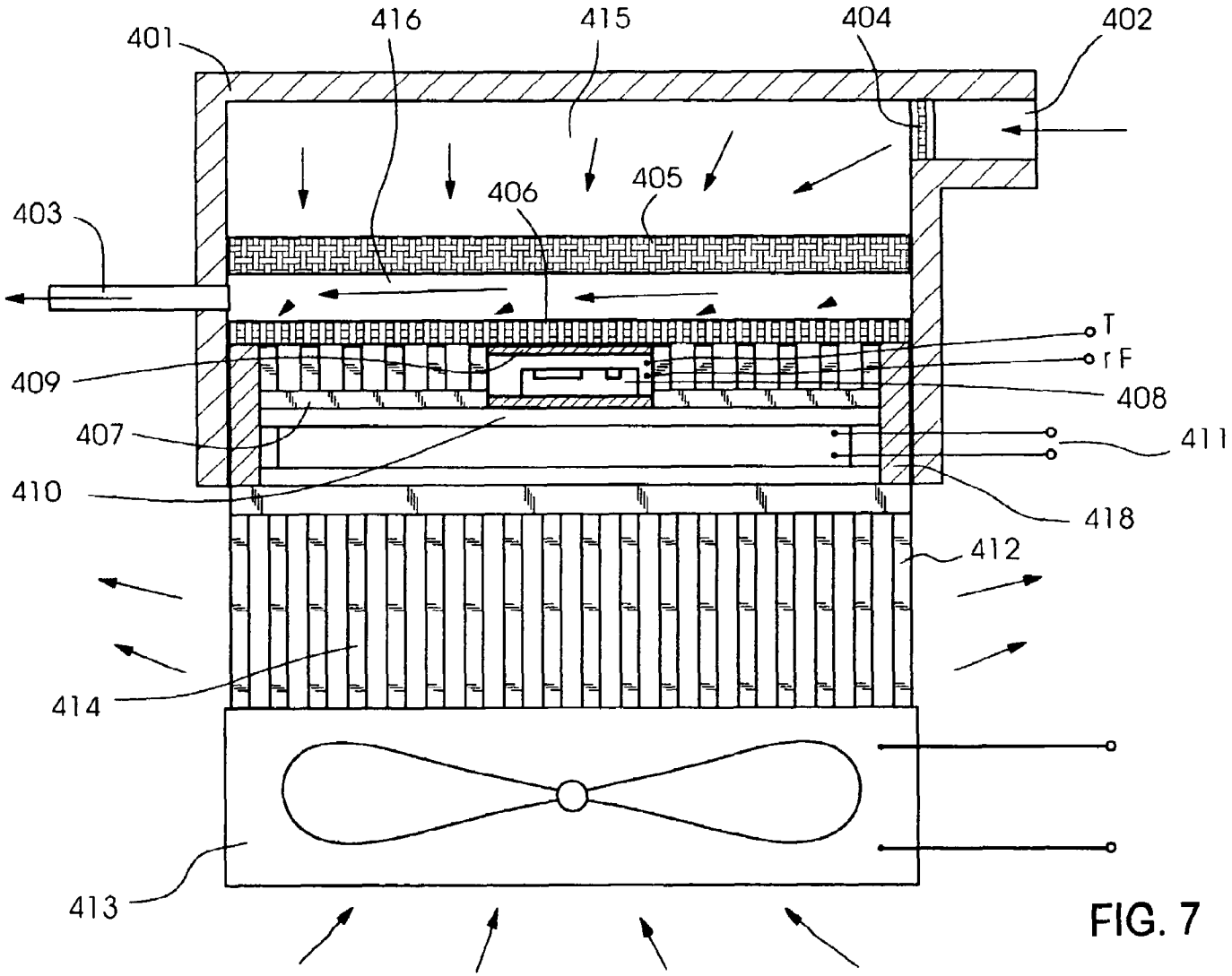
FIG. 7 is a simplified sketch for a measuring cell for the accurate determination of the relative atmospheric humidity.

In FIG. 7, a measuring cell for the more accurate measurement of the relative humidity in the waste air from the dryers 10*a*/10*b* is described: The measuring cell has a pot-like or box-like housing 401, which is provided at the bottom with an air inlet connecting piece 402 and offset opposite, approximately centrally in relation to the wall of the pot-like or box-like housing, and has an air outlet connecting piece 403. The air inlet connecting piece 402 has a very much larger cross section than the air outlet connecting piece 403, in order that the pressure level does not change in the measuring cell but corresponds approximately to the pressure of the main stream of the dryer waste air, from which the measuring stream is branched off.

A coarse grid 404 in the air inlet connecting piece prevents foreign bodies penetrating into the measuring cell. A finer dust filter 405 divides the measuring cell between the air inlet connecting piece and the air outlet connecting piece. Because of its large diameter, which corresponds to that of the measuring cell, the dust filter 405 does not represent any flow resistance worth mentioning. It divides the volume of the measuring cell into an inlet region 415, wherein the air still has the temperature and humidity of the main waste air stream, and into a measuring volume 416, wherein the air is cooled, as explained below, and is measured with regard to temperature and relative atmospheric humidity.

The cover of the measuring cell is formed by a ring 418, wherein a Peltier element 410 is accommodated. The Peltier element is provided on both sides with heat sinks, the heat sink 414 keeping the "hot" side of the Peltier element at ambient temperature, which is assisted by a fan 413. Peltier element 410, heat sink 414 and fan 413 form a commercially available structural unit, as used for example for cooling electronic components. Such structural units can be obtained relatively inexpensively.

The intermediate ring 418 consists of thermally insulating material, in order to prevent a thermal short circuit between the two sides of the Peltier element.

A grid 406 of metal rests on the heat sink 407 on the "cold" side of the Peltier element 410. The grid 406 has a relatively coarse mesh and permits the passage of air between the measuring volume 416 and the sensor region located beneath. The grid 406 is in thermal contact with the heat sink 407 and therefore assumes the temperature of the latter. On account of the very large surface of heat sink 407 and grid 406, the air passing out of the measuring volume 416 through the grid 406 and reaching the sensor 408 assumes the temperature of the heat sink. This is kept at about 35° C., in order to prevent the moisture in the air condensing out in the region of the sensor.

The sensor 408 is an inexpensive, commercially available sensor for measuring the relative atmospheric humidity and the temperature, such as is sold, for example, by the company Sensirion Inc, Westlake Village, Calif., USA, under the product designation SHT75. The two values, the value of the relative atmospheric humidity and the temperature measured value, are used to determine the absolute humidity in the waste air from the dryers 10*a*/10*b*, as described by using the other figures. At the same time, the temperature measuring element of the sensor 408 is used to regulate the temperature in the measuring cell to values between about 25° and 40° C., which are uncritical with respect to the condensation of water vapor, with the aid of the Peltier element 410. Additional protection against condensation may be achieved by the measured signal of the relative humidity also being taken into account. For example, in the event that rF>80% is exceeded, the temperature in the measuring volume 416 can be raised by the Peltier element 410 being used for heating by reversing the polarity of the current direction. In that case, the Peltier element 410 can be controlled and regulated with the aid of the humidity signal and the temperature signal from the sensor 408 in such a way that the sensor always operates in a climatic range which is uncritical with regard to the condensation of vapor but optimal in relation to the measuring accuracy of the humidity measurement.

In the present example, the invention has been described by using a moisture balance that is set up since, in the case of emulsion varnishes, the important material streams contain water. Besides this, it is possible in the same way, for example when using varnishes based on (organic) solvents, to balance the input and output of the solvents, for example of the IPA (isopropanol), and to provide this balance visually through the printer for the optimization.

The invention claimed is:

1. A method of determining operating parameters of a printing press, the method which comprises:

providing at least one control device;

providing a plurality of printing units;

providing at least one varnishing unit;

providing at least one dryer device;

performing a drying process by passing printed material through the at least one dryer device by using the moisture stream in the waste heat to control an output of the at least one dryer device and/or a speed of the printing press;

expelling waste heat from the at least one dryer device; and optimizing the drying process by measuring a moisture stream or amount of water in the waste heat expelled from the at least one dryer device which comprises using the moisture stream in the waste heat to control an output of the at least one dryer device and/or a speed of the printing press.

2. The method according to claim 1, which comprises determining characteristic data of the moisture stream and displaying the characteristic data visually.

3. The method according to claim 1, which comprises feeding air into the at least one dryer device, and additionally determining a moisture loading of the air fed into the at least one dryer device.

4. The method according to claim 3, which comprises additionally determining a moisture content transported into the at least one dryer device with the printing material.

5. The method according to claim 4, which comprises determining the moisture content from the application of varnish.

6. The method according to claim 3, which comprises additionally determining a moisture of the printing material leaving the dryer device or the printing press.

7. The method according to claim 3, which comprises determining a quantity of water fed into the dryer device per unit time and/or a quantity of water carried away from the dryer device per unit time.

8. The method according to claim 7, wherein the step of determining the quantity of water comprises measuring a volume flow of feed air, a volume flow of waste air, and/or a quantity of varnish printed in the varnishing unit.

9. The method according to claim 7, which comprises additionally measuring a temperature of the feed air into the dryer device and a temperature of the waste air from the dryer device.

10. The method according to claim 7, which comprises additionally measuring a temperature of the printing material before and/or after passing through the dryer device.

11. The method according to claim 1, which comprises determining a moisture balance for the at least one dryer device.

12. The method according to claim 2, which comprises representing the moisture stream in the waste heat by symbols of variable size.

13. The method according to claim 2, wherein the step of displaying the characteristic data of the moisture stream in the waste heat comprises displaying measured values of the characteristic data and corresponding measuring locations.

14. The method according to claim 2, wherein the step of displaying the characteristic data of the moisture stream comprises displaying at least some deviations from desired values.

15. The method according to claim 1, wherein the printing press comprises a plurality of dryer devices and the method comprises determining partial streams of measured moisture for the plurality of dryer devices.

16. The method according to claim 2, wherein the step of displaying the characteristic data comprises displaying limiting values within which a drying process operates stably.

17. The method according to claim 2, which comprises logging a course of the measured characteristic data of the moisture stream.

18. A method of determining operating parameters of a printing press, the method which comprises:

providing at least one control device;

providing a plurality of printing units;

providing at least one varnishing unit for emulsion varnishes;

providing a thermal dryer device;

performing a drying process by passing printed material through the thermal dryer device;

expelling waste air from the thermal dryer device by using the moisture stream or the amount of water in the waste air to control an output of the at least one dryer device and/or a speed of the printing press; and measuring an amount of moisture or an amount of water in the waste air expelled from the thermal dryer device.

* * * * *

UNITED STATES PATENT AND TRADEMARK OFFICE

CERTIFICATE OF CORRECTION

PATENT NO. : 7,954,431 B2
APPLICATION NO. : 11/811432
DATED : June 7, 2011
INVENTOR(S) : Jochen Jung et al.

It is certified that error appears in the above-identified patent and that said Letters Patent is hereby corrected as shown below:

Column 10, lines 40-57, Claim 1 should read as follows:

1. A method of determining operating parameters of a printing press, the method which comprises:
providing at least one control device;
providing a plurality of printing units;
providing at least one varnishing unit;
providing at least one dryer device;
performing a drying process by passing printed material through the at least one dryer device;
expelling waste heat from the at least one dryer device; and
optimizing the drying process by measuring a moisture stream or amount of water in the waste heat expelled from the at least one dryer device by using the moisture stream in the waste heat to control an output of the at least one dryer device and/or a speed of the printing press.

Column 12, lines 30-42, Claim 19 should read as follows:

19. A method of determining operating parameters of a printing press, the method which comprises:
providing at least one control device;
providing a plurality of printing units;
providing at least one varnishing unit for emulsion varnishes;
providing a thermal dryer device;
performing a drying process by passing printed material through the thermal dryer device;
expelling waste air from the thermal dryer device; and
measuring an amount of moisture or an amount of water in the waste air expelled from the thermal dryer device by using the amount of moisture or the amount of water in the waste air to control an output of the at least one dryer device and/or a speed of the printing press.

Signed and Sealed this
Twenty-fourth Day of July, 2012

David J. Kappos

David J. Kappos
*Director of the United States Patent and Trademark Office*